US005176720A

United States Patent [19]

Martell et al.

[11] Patent Number: 5,176,720

[45] Date of Patent: Jan. 5, 1993

[54] COMPOSITE ABRASIVE COMPACTS

[76] Inventors: Trevor J. Martell, 8 Erica Place, Vale Road, Weltevreden Park, Johannesburg, Transvaal; Klaus Tank, 9 Warbleton Avenue, Essexwold, Johannesburg, Transvaal, both of South Africa

[21] Appl. No.: 567,939

[22] Filed: Aug. 15, 1990

[30] Foreign Application Priority Data

Sep. 14, 1989 [ZA] South Africa ..... 89/7018

[51] Int. Cl.[5] ..... B24D 3/00

[52] U.S. Cl. ..... 51/293; 51/307; 51/309

[58] Field of Search ..... 51/293, 307, 309

[56] References Cited

U.S. PATENT DOCUMENTS

| | | | |
|---|---|---|---|
| 3,743,897 | 7/1973 | Wentorf, Jr. et al. | 51/307 |
| 3,745,623 | 7/1973 | Wentorf, Jr. et al. | 29/95 |
| 3,767,371 | 10/1973 | Wentorf, Jr. et al. | 51/307 |
| 4,063,909 | 12/1977 | Mitchell | 51/309 |
| 4,117,968 | 10/1978 | Naidich et al. | 51/309 |
| 4,224,380 | 9/1980 | Bovenkerk et al. | 51/309 |
| 4,225,322 | 9/1980 | Knemeyer | 51/295 |
| 4,228,942 | 10/1980 | Dietrich | 51/309 |
| 4,311,490 | 1/1982 | Bovenkerk et al. | 51/307 |
| 4,505,721 | 3/1985 | Almond et al. | 51/293 |
| 4,527,998 | 7/1985 | Knemeyer | 51/293 |
| 4,534,773 | 8/1985 | Phaal et al. | 51/293 |
| 4,662,896 | 5/1987 | Dennis | 51/293 |
| 4,666,466 | 5/1987 | Wilson | 51/307 |
| 4,789,385 | 12/1988 | Dyer et al. | 51/293 |
| 4,802,895 | 2/1989 | Burnaud et al. | 51/293 |
| 4,807,402 | 2/1989 | Rai | 51/293 |
| 4,824,442 | 4/1989 | Cerceau | 51/309 |
| 4,875,907 | 10/1989 | Phaal et al. | 51/309 |
| 5,011,509 | 4/1991 | Frushour | 51/293 |

FOREIGN PATENT DOCUMENTS

| | | |
|---|---|---|
| 038072 | 10/1981 | European Pat. Off. . |
| 0296055 | 2/1988 | European Pat. Off. . |
| 0371251 | 6/1990 | European Pat. Off. . |
| 1151666 | 7/1963 | Fed. Rep. of Germany . |
| 885847 | 4/1989 | South Africa . |
| 1489130 | 10/1977 | United Kingdom . |
| 2158086 | 6/1985 | United Kingdom . |

OTHER PUBLICATIONS

*Chemical Abstracts*, vol. 91, No. 91:111602 W; (1979).

*Primary Examiner*—William R. Dixon, Jr.
*Assistant Examiner*—Willie J. Thompson
*Attorney, Agent, or Firm*—Scully, Scott, Murphy & Presser

[57] ABSTRACT

A method of producing a composite abrasive compact is provided. The method includes the steps of providing a cemented carbide substrate having two layers separated by a metallic layer. The metal of the metallic layer may be a ductile metal such as cobalt or nickel or a refractory, carbide-forming metal such as molybdenum, tantalum, niobium, hafnium, titanium or zirconium. A layer of the components, in particulate form, necessary to produce an abrasive compact is placed in a recess of the one layer to produce an unbonded assembly. The unbonded assembly is then subjected to suitable conditions of elevated temperature and pressure to produce an abrasive compact from the components.

10 Claims, 1 Drawing Sheet

COMPOSITE ABRASIVE COMPACTS

BACKGROUND OF THE INVENTION

This invention relates to composite abrasive compacts.

Abrasive compacts are used extensively in cutting, milling, grinding, drilling and other abrasive operations. Abrasive compacts consist of a mass of diamond or cubic boron nitride particles bonded into a coherent, polycrystalline hard conglomerate. The abrasive particle content of abrasive compacts is high and there is an extensive amount of direct particle-to-particle bonding. Abrasive compacts are generally made under elevated temperature and pressure conditions at which the abrasive particle, be it diamond or cubic boron nitride, is crystallographically stable.

Abrasive compacts tend to be brittle and in use they are frequently supported by being bonded to a cemented carbide substrate or support. Such supported abrasive compacts are known in the art as composite abrasive compacts. The composite abrasive compact may be used as such in the working surface of an abrasive tool.

Examples of composite abrasive compacts can be found described in U.S. Pat. Nos. 3,745,623, 3,767,371 and 3,743,489.

Composite abrasive compacts are generally produced by placing the components, in particulate form, necessary to form an abrasive compact on a cemented carbide substrate. This unbonded assembly is placed in a reaction capsule which is then placed in the reaction zone of a conventional high pressure/high temperature apparatus. The contents of the reaction capsule are subjected to suitable conditions of elevated temperature and pressure.

It does happen from time to time that substantial portions of a composite diamond abrasive compact break off during use. The break off occurs through both the compact layer and the carbide substrate rendering that composite abrasive compact useless for further work. It is believed that this type of catastrophic failure results, in part, from stresses set up in the carbide substrate by an uneven distribution of binder metal in that substrate. During manufacture of the composite abrasive compact, binder from the substrate infiltrates the diamond layer resulting in binder-lean regions being formed in the carbide substrate. Such regions are susceptible to stress cracking.

U.S. Pat. No. 4,225,322 describes a method of fabricating a tool component comprised of a composite abrasive compact bonded to a carbide pin by a layer of brazing filler metal. The method involves placing a layer of the brazing filler metal between a surface of the carbide substrate of the composite abrasive compact and the pin and disposing the composite abrasive compact in thermal contact with a heat sink during the subsequent brazing operation. Bonding between the carbide substrate and the carbide pin takes place under ambient pressure conditions.

SUMMARY OF THE INVENTION

According to the present invention, there is provided a method of producing a composite abrasive compact including the steps of providing a cemented carbide substrate having at least two co-operating sections separated by a metallic layer, placing a layer of the components, in particulate form, necessary to produce an abrasive compact on a surface of the substrate to produce an unbonded assembly, and subjecting the unbonded assembly to suitable conditions of elevated temperature and pressure to produce an abrasive compact from the components.

DESCRIPTION OF EMBODIMENTS

Figure 1:
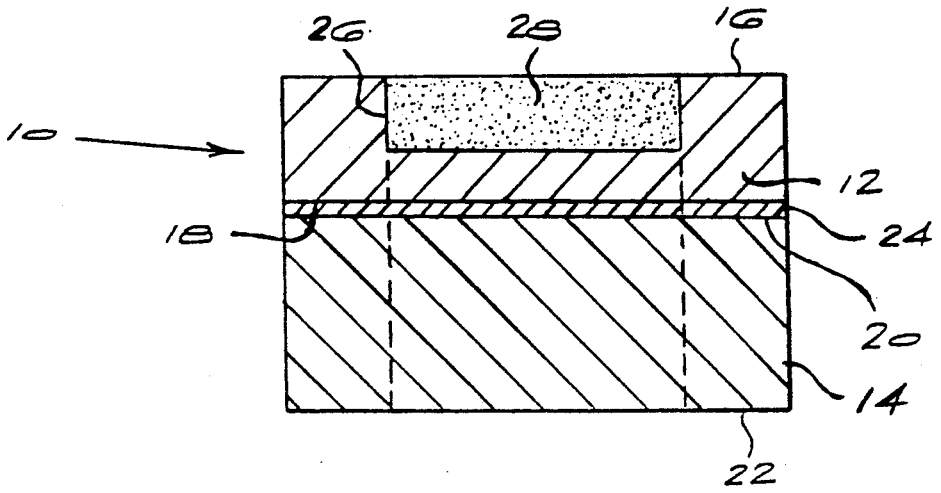
FIG. 1 is a sectional side view of an unbonded assembly useful in the practice of the invention.

The sections of the carbide substrate will typically consist of layers, preferably two layers, placed one on top of the other and sandwiching metallic layers between adjacent layers. The components for producing the abrasive compact will be placed on a surface of one of the layers.

The carbide of the various layers may each contain the same quantity of binder metal. Alternatively, this binder metal content may vary from layer to layer. Preferably, the layer which carries the components for producing the abrasive compact will have a different binder metal content than the other layer or layers. In one particular example of the invention, the carbide substrate is provided in two layers, the layer carrying the components having a binder metal content in the range 9 to 15%, typically 13%, by weight and the other layer having a binder metal content in the range 18 to 30%, typically 20%, by weight.

The metallic layer may be a metal layer or an alloy layer.

In one form of the invention, the metallic layer is a layer of a ductile metal. Such a metal will generally be chosen to allow diffusion bonding to occur between adjacent carbide sections and may be one having a low yield point, e.g. about 100MPa, and high elongation. Examples of such metals are nickle and cobalt and noble metals, particularly platinum.

The metallic layer may also be a layer of a refractory, carbide-forming metal such as molybdenum, tantalum, titanium, niobium, hafnium or zirconium. Such metals are high melting and have the advantage of creating a thermal barrier which protects, to some extent, the abrasive compact during subsequent brazing of the composite abrasive compact to a working surface of a tool.

The metallic layer may also consist of two or more metal layers. These layers may, for example, be alternating layers of a ductile metal and a refractory, carbide-forming metal.

The thickness of the metallic layer will generally be in the range of 50 to 1000 microns, typically about 500 microns.

The components necessary to produce the abrasive compact are known in the art and will vary according to the nature of the compact being produced. In the case of diamond compacts, the component is generally the diamond particles alone with the binder metal infiltrating the diamond particles from the substrate during compact manufacture.

The invention has particular application to the manufacture of composite diamond abrasive compacts. The problems of stress cracking and catastrophic failure manifest themselves particularly with such compacts.

The cemented carbide may be any known in the art such as cemented tantalum carbide, cemented titanium carbide, cemented tungsten carbide and mixtures thereof. The binder metals for such carbides are typically cobalt, iron or nickel.

The elevated temperature and pressure conditions which are used will generally be a temperature in the range 1400° to 1600° C. and a pressure in the range 50 to 70 kilobars.

The composite abrasive compacts produced by the method of the invention can be used in a variety of known applications such as in rotary drills, coal picks, cutting tools and the like.

An embodiment of the invention will now be described with reference to the accompanying drawing. Referring to this drawing, there is shown an unbonded assembly comprising a cemented carbide substrate 10 consisting of two layers 12 and 14. The layer 12 has major surfaces 16 and 18 on each of opposite sides thereof. The layer 14 also has major surfaces 20 and 22 on each of opposite sides thereof.

Interposed between the surfaces 18 and 20 is a layer 24 of a ductile metal such as cobalt.

A recess 26 is formed in the major surface 16 of the layer 12. A mass of diamond particles 28 is placed in this recess to fill it completely.

The unbonded assembly is placed in the reaction zone of a conventional high temperature/high pressure apparatus and subjected to a temperature of 1400° to 1600° C. and a pressure of 50 to 60 kilobars. These elevated conditions are maintained for a period of 15 minutes. During this time cobalt from the layer 12 infiltrates into the diamond mass 28 and cobalt from layer 24 diffuses into both the carbide layers 12 and 14 creating a very strong diffusion bond.

Figure 2:
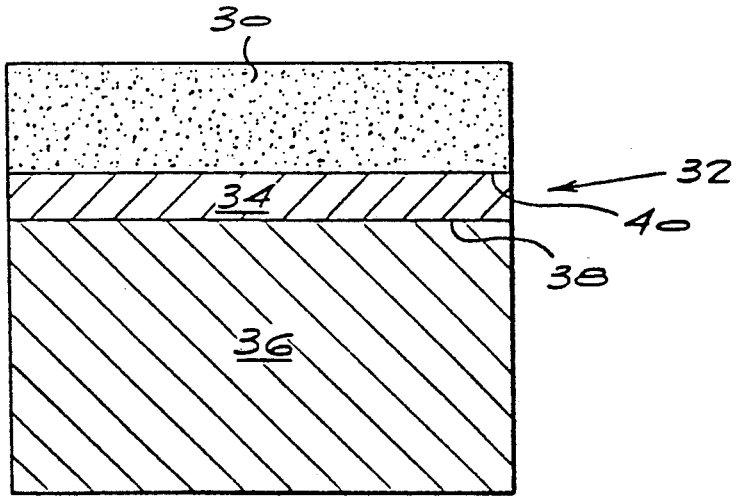
FIG. 2 is a sectional side view of a composite abrasive compact produced from the assembly of FIG. 1.

After release of the elevated temperature and pressure conditions, the now bonded assembly is removed from the reaction zone and the carbide sides removed as indicated by the dotted lines. The resulting product is as illustrated by FIG. 2 and is a composite abrasive compact consisting of a diamond compact 30 bonded to a cemented carbide substrate 32 which consists of two sections 34 and 36 bonded along the interface 38. The interface 38 will be rich in cobalt relative to the remainder of the substrate. The interface 38 will typically be about 2 mm below the lower surface 40 of the compact 30. It has been found that stresses within stressed regions in the layered carbide substrate 32 are significantly reduced leading to a much lower incidence of catastrophic failure of the composite compacts occurring during use.

We claim:

1. A method of producing a composite abrasive compact comprising the steps of providing a cemented carbide substrate having at least two co-operating sections separated by a metallic layer, placing a layer of the components, in particulate form, necessary to produce an abrasive compact on a surface of the substrate to produce an unbonded assembly, and subjecting the unbonded assembly to suitable conditions of elevated temperature and pressure to produce an abrasive compact from the components.

2. A method according to claim 1 wherein the sections of the carbide substrate consist of layers placed one on top of the other and sandwiching metallic layers between adjacent layers.

3. A method according to claim 2 wherein the layers contain a binder metal and the layer which carries the components for producing the abrasive compact has a different binder metal content than the other layer or layers.

4. A method according to claim 3 wherein there are two layers, the layer carrying the components having a binder metal content in the range 9 to 15% by weight and the other layer having a binder metal content in the range 18 to 30% by weight.

5. A method according to claim 1 wherein the metallic layer is a layer of a ductile metal.

6. A method according to claim 5 wherein the ductile metal is selected from nickel, cobalt, and the noble metals.

7. A method according to claim 1 wherein the metallic layer is a layer of a refractory, carbide-forming metal.

8. A method according to claim 7 wherein the refractory, carbide-forming metal is selected from molybdenum, tantalum, niobium, hafnium, titanium and zirconium.

9. A method according to claim 1 wherein the metallic layer consists of two or more layers of different metals.

10. A method according to claim 1 wherein the elevated temperature is in the range 1400° to 1600° C. and the elevated pressure is in the range 50 to 70 kilobars.

* * * * *